US005212894A

United States Patent [19]

Paparo

[11] Patent Number: 5,212,894

[45] Date of Patent: May 25, 1993

[54] GOLF SHOE INSOLES FOR IMPROVING THE GOLF SWING

[76] Inventor: Michael Paparo, 7341 Amberly La., Penthouse #1, Delray Beach, Fla. 33446

[21] Appl. No.: 476,559

[22] Filed: Feb. 7, 1990

[51] Int. Cl.[5] ..... A43B 13/38; A43B 5/00

[52] U.S. Cl. ..... 36/43; 36/127

[58] Field of Search ..... 36/43, 44, 71, 127; 128/584, 585

[56] References Cited

U.S. PATENT DOCUMENTS

| | | | |
|---|---|---|---|
| 1,039,396 | 9/1912 | Hilgert | 36/43 |
| 2,067,240 | 1/1937 | Musebeck | 128/585 |
| 2,599,317 | 6/1952 | Brady | 36/44 |
| 2,847,769 | 8/1958 | Schlesinger | 36/127 |
| 3,309,797 | 3/1967 | Poitras | 128/585 |
| 3,738,373 | 6/1973 | Glancy | 128/585 |
| 4,149,324 | 4/1979 | Lesser et al. | 36/71 |
| 4,442,612 | 4/1984 | Hauser | 36/71 |
| 4,682,425 | 7/1987 | Simmons | 36/127 |
| 4,704,809 | 11/1987 | Ballard | 36/127 |

FOREIGN PATENT DOCUMENTS

| | | | |
|---|---|---|---|
| 300656 | 9/1932 | Italy | 30/44 |
| 8707480 | 12/1987 | PCT Int'l Appl. | 36/127 |
| 475100 | 4/1929 | United Kingdom | 36/43 |

*Primary Examiner*—Steven N. Meyers

*Attorney, Agent, or Firm*—Malin, Haley, DiMaggio & Crosby

[57] ABSTRACT

This invention relates to a device that is inserted into a golfer's shoes as a front and rear insole in order to have each foot respond properly, yet differently during the golf swing to achieve the optimum golf swing. The front foot (relative to the ball direction) includes an insole insert having a centerline thickness longitudinally to encourage a rolling action of the front foot during the swing, while the rear foot includes a wedge-shaped insole to properly position the back foot during the swing.

8 Claims, 1 Drawing Sheet

GOLF SHOE INSOLES FOR IMPROVING THE GOLF SWING

BACKGROUND OF THE INVENTION

1. Field of the Invention

This invention relates to insertable golf shoe insoles that improve both the position and the dynamic action of a golfer's feet during a golf swing for an improved swing, and specifically front and rear foot insoles individually configured to provide different tactile pressure sensations in each foot during a golf swing.

2. Description of the Prior Art

In search of the optimum golf swing, golfers have long recognized that the golfer's feet play an extremely important role since they are the foundation of the body and must dynamically react during the golf swing to achieve the transfer of weight from the rear foot to the front foot. (Rear to front connotes the direction the ball is to be hit.) Numerous devices in prior U.S. patents have tried to provide solutions to improve the golf swing. Several patents disclose the use of insole wedges which are inserted into both golf shoes to raise the outside heel area of each foot to assist the golfer to ensure proper weight distribution on each heel. U.S. Pat. No. 4,682,425 issued to Ronald G. Simmons on Jul. 28, 1987 discloses adapters that are used in golf shoes that have a raised portion on the outside edge of both feet and allow some weight shift to the toe area. U.S. Pat. No. 2,847,769 issued to Schlesinger Aug. 19, 1958 shows shoes which have wedged heels in the left and right shoe to accomplish a similar purpose. U.S. Pat. No. 4,704,809 issued to Ballard on Nov. 10, 1987 shows a wedge-shaped sole and heel incorporated into each golf shoe.

The primary problem with all the devices shown in the prior art is that they treat both the back foot and the front foot in exactly the same way. The fact is that the front foot functions differently than the rear foot during the swing. In the optimum golf swing, it is noted that weight shift is essential from the back foot to the front foot but also that impact and follow through are necessary for the proper swing. The actual dynamic motion of each foot during the golf swing is different when comparing the position and motion of the back foot with the position and motion of the front foot. Specifically, at club impact on the ball and follow through, the front foot during the weight shift should roll about its longitudinal axis and the body weight should be on the outside of the front foot at the end of the swing. In contrast, the back foot should remain firmly planted with the weight on the inside of the rear foot and during the initial part of the swing allowing the weight transfer to go from the back foot to the front foot. None of the devices shown in the prior art deal with the fact that each foot must react differently to achieve the optimum golf swing.

The present invention overcomes this problem by providing a set of insoles for a golfer's shoes in which the back shoe insole is structurally and functionally quite different than the front foot insole, while together they cooperate to produce the correct feet dynamics for the optimum swing.

SUMMARY OF THE INVENTION

A set of golf shoe insoles for improving the position and individual dynamic activity of a golfer's back foot and front foot during the golf swing to ensure an optimum golf swing. The set of golf shoe insoles is comprised of one insole for the rear golf shoe and a structurally different insole for the front golf shoe.

The rear golf shoe insole is comprised of a resilient foam pad sized to cover the heel area of the shoe up to the front of the arch and includes a wedge-shaped lateral cross-sectional area with the thickest portion of the wedge formed along one lateral edge tapering across the insole to the opposite lateral edge. In use, the thicker lateral edge is to be positioned toward the outside of the rear foot away from the instep. The purpose of the wedge is to provide a tactile pressure sensation to the golfer's rear foot that will consciously and subconsciously result in the proper positioning of the rear foot during the golf swing.

Of critical importance however is not only the action of the back foot during the swing, but equally important is the action of the front foot during the swing which includes the weight shift, impact of the ball and follow through. The front foot, in distinction to the action of the rear foot, will commence a roll about its longitudinal axis during the weight transfer and follow through such that at the end of the golf swing, the front foot should have the body weight along its middle to outside edge. The weight should be transferred to the front foot during the swing by a rolling action of the front foot.

The front insole is comprised of a resilient pad which has its thickest portion along a central longitudinal axis and reduced thicknesses at the side edges. The central longitudinal raised portion thus provides a tactile sensation to the golfer's heel area which consciously and subconsciously suggests and aids in the rolling action of the front foot during the swing.

Therefore it can be seen that the outside wedge action on the rear foot in combination with the raised centerline insole which encourages proper rolling of the front foot cause the insoles to work together to establish the proper dynamics for each foot.

Each insole may be sculptured from a resilient leather material or molded from resilient foam material. There can be variations in the amount of resiliency, depending upon the particular size of the golfer and anticipated compression weight provided that there is sufficient thicknesses at compression to give the necessary tactile pressure sensation to the golfer's feet when the insoles are in use.

It is an object of this invention to provide a set of golf shoe insoles each of a different configuration for a golfer to improve the proper dynamic action of the golfer's feet during a golf swing to achieve the optimum swing.

It is another object of this invention to provide a set of golf shoe insoles each configured differently in which one insole provides tactile pressure sensations to the rear foot and the other insole provides different tactile pressure sensations to the front foot for the proper positioning and dynamic action of a golfer's feet to improve the swing.

And yet another object of this invention is to provide a front foot golf shoe insole which can aid and enhance the rolling action of the front foot to ensure proper weight transfer to the outside of the front foot during the golf swing.

And yet still another object of this invention is to provide improved golf shoes having a specific insole and heel configuration to improve the golf swing of the wearer.

In accordance with these and other objects which will be apparent hereinafter, the instant invention will now be described with particular reference to the accompanying drawings.

PREFERRED EMBODIMENT OF THE INVENTION

Figure 1A:
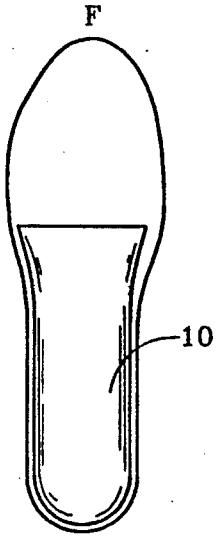
FIG. 1 is a diagram showing the location of the of the front and rear insoles in accordance with the invention relative to the outline of the golf shoe.
Figure 1B:
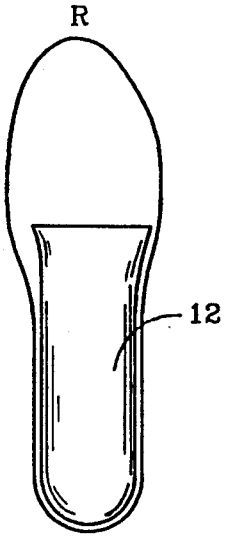

Referring now to the drawings, and specifically FIG. 1, Applicant's invention is shown as insole 10 and its relationship to the golfer's front foot shoe (F), the front foot being determined relative to the direction that ball B is to be driven (arrow). The golfer's rear foot shoe (R) includes insole 12. Together insole 10 and insole 12 because of their different configurations, provide through their resilient padding and thicknesses, different pressure sensations to the golfer's front and rear feet to ensure correct position and dynamic action of the feet during the golf swing. In each case the insole extends from the heel to the top of the instep.

Figure 2A:
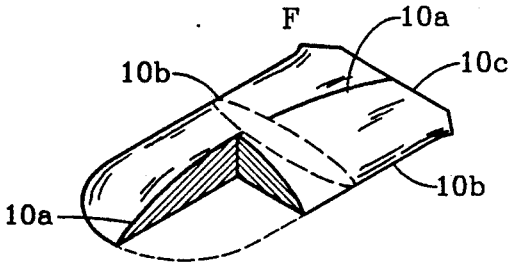
FIGS. 2A and 2B show a perspective view partially cut away of both the front insole and the rear insole respectively in accordance with the invention.
Figure 2B:
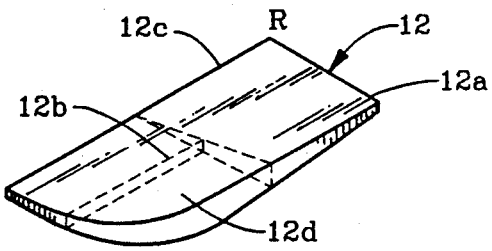

Referring to FIGS. 2A and 2B it is quite evident that the cross-sectional configuration and shape of front foot F insole 10 in FIG. 2A is quite different than the cross-sectional shape and configuration of insole 12 used with the rear foot R in FIG. 2B. The front insole 10 has a center line 10*c* running longitudinally from front to rear that has an enlarged thickness compared to the lateral edges 10*b*. The lateral cross-sectional shape is arcuate (both on top and bottom) such that the center-line thickness 10*a* near the mid section is approximately twice as thick symmetrically as at half the distance between edge 10*b* and center line 10*a*. The forward end of the insole 10*c* and the rearward tip 10*d* define an elongated elliptical longitudinal cross sectional area, with the longitudinal first quarter length being the thickest portion from rear to front of insole 10. The principal reason for making the longitudinal centerline of insole 10 its thickest portion is to create pressure on the centerline of the golfer's foot generating a tactile sensation to encourage the foot to act like a fulcrum about which the front foot would pivot during the golf swing as the weight is transferred to the front foot. Since the insole 10 configuration is laterally symmetrical, the configuration enhances the conscious and subconscious activation of the front foot to encourage the actual rolling movement of the front foot so necessary for execution of the optimum golf swing.

The rear insole 12 is quite different than insole 10 in cross-sectional configuration through the lateral center. The edge 12*d* at the back part of the heel represents the thickest portion of the insole which tapers in thickness laterally and longitudinally gradually diminishing to the minimal or zero thickness edge 12*c* and 12*a* respectively. The insole 12 is positioned in the golf shoe such that the thickest point 12*d* would lie along the rear outside of the foot (in a direction away from the instep). With regard to the rear foot of the golfer during the golf swing, the purpose of insole 12 is to maintain the weight of the golfer inside of the rear foot as a push-off in the initial part of the golf swing when most of the body weight is on the rear foot.

In accordance with the invention it is important to note that the front insole 10 is different in structure and function than the rear insole 12 as has been described.

Figure 3A:
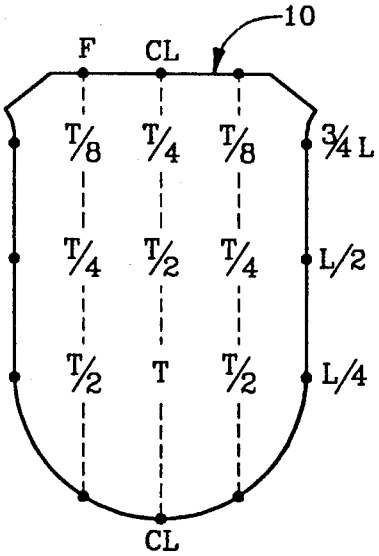
FIGS. 3A and 3B are diagrams relating to the areas of relative thicknesses of the front insole and the rear insole respectively.
Figure 3B:
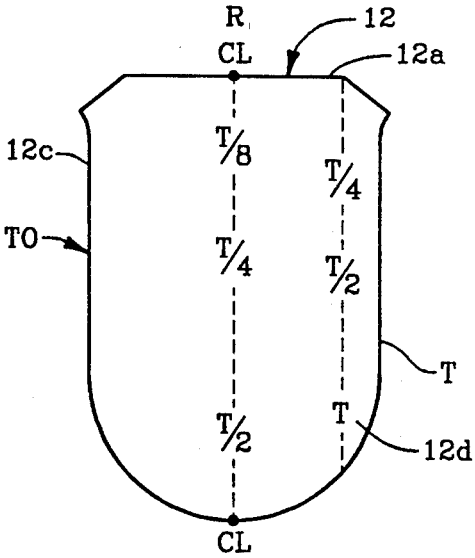

FIGS. 3A and 3B show diagrams of one embodiment of the invention representing the various thicknesses discussed herein. With respect to the front insole 10 in FIG. 2A, the longitudinal center-line CL is the thickest portion especially near the rear of the heel, at one-fourth of the length and at L/4. Proceeding laterally at one-fourth length the thickness drops to approximately one-half symmetrically on each side of the center-line, half way from the center-line to each edge. At one-half length L/2, the thickness is decreased symmetrically toward each edge to one-quarter thickness. At three quarters of the length, the thickness may drop along the center-line to one quarter while symmetrically dropping to one-eighth laterally on each side of the center-line half way to each edge. An important characteristic of insole 10 is to ensure that there is a sufficient longitudinal center-line thickness and symmetrically thinner lateral areas, formed on each side of the insole so that the center line of the golfer's heel will receive sufficient tactile pressure to produce a sensation that will encourage consciously and subconsciously the front foot to roll about the longitudinal center-line of the foot during the weight transfer from rear to front foot to achieve the optimum golf swing.

The insole 10 may be made from a resilient foam material and along its center line thickness would be approximately $\frac{3}{8}$ inches. However this thickness can be varied, especially in view of the different potential weights of golfers and the particular insole material selected as to its compressibility and ability to provide the proper tactile sensation so that the golfer has a realization of its presence.

In FIG. 3B the rear insole 12 is shown which shows its thickest point 12*d*. While the longitudinal center line is one-half the thickness. The opposite edge T0 represents the fact that the along the edge 12*c* the thickness is minimal as is edge 2*a*. As an example, using a resilient foam material, the thickness T may be 3/16 inches while the center line would be 3/32 inches.

Figure 4A:
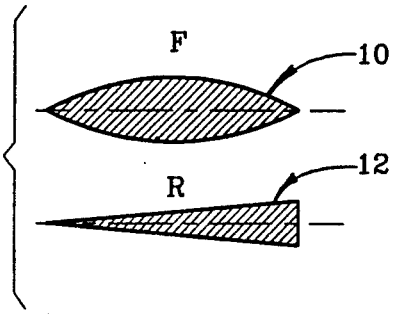
FIG. 4A shows an elevational cross-sectional view of one configuration of the front insole and of the rear insole.

FIG. 4A shows a cross sectional view in elevation of insole 10 which shows its arcuate shape on top and bottom and that it is symmetrical about the center line from side to side. This is important in that with a symmetrical construction as shown, the front insole 10 may be used for either a right-handed or a left-handed golfer by insertion into the golf shoe which represents the front foot relative to the direction that the ball is to be hit. Likewise the rear insole 12 may also be symmetrical through a center line so that it may also be used by a right-handed golfer or a left-handed golfer by insertion into the rear golf shoe.

Figure 4B:
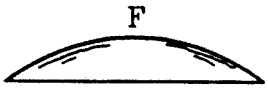
FIG. 4B shows an alternate embodiment of the configuration of the invention in a cross-sectional elevational view for the front foot insole.

It is equally desireable that the front insole could be shaped in a configuration as shown in FIG. 4B, namely an arcuate top portion and a flat bottom. This configuration readily provides the necessary center line foot pressure sensation running longitudinally to instruct the golfer as to the proper movement of the front foot during the golf swing. This configuration can be used in the front shoe of either a right-handed or left-handed golfer.

Figure 4C:
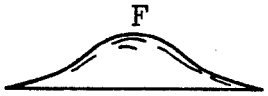
FIG. 4C shows a cross-sectional elevational view of yet another configuration of the front insole in accordance with the invention.

FIG. 4C shows a somewhat less arcuate upper portion but that includes at least a raised thickness along the center line to provide the proper pressure sensation for the front foot of the golfer along the heel area.

The instant invention has been shown and described herein in what it is considered to be the most practical and preferred embodiment. It is recognized, however, that departures may be made therefrom within the scope of the invention and that obvious modifications will occur to a person skilled in the art.

What I claim is:

1. A set of golf shoe insoles each having a different configuration for improving the position and dynamic activity of each foot of a golfer which cooperate together during the golf swing to ensure a correct golf swing comprising:

a first insole for the front foot relative to the direction of the ball, said first insole having a longitudinal axis centrally disposed between lateral edges and sized to extend longitudinally from the front of the arch to the back of the heel in a golfer's shoe and laterally across the heel, said first insole having a sufficient thickness along said longitudinal centerline axis that is larger than any other thickness from the centerline to the lateral edges, said thickness along the longitudinal axis sized sufficiently to provide a tactile pressure on the golfer's front foot heel area to encourage the front foot to achieve a rolling motion about the longitudinal centerline axis during the golf swing; and a second insole for the back foot relative to the direction of the ball, said second insole having a first lateral side and a second lateral side and sized in length to extend from the front of the arch to the back of the heel in a golfer's shoe and substantially laterally across the heel area in the shoe, said second insole thickness being greater in thickness along said first lateral side and tapered in diminishing thickness from said first lateral side to said second lateral side forming a wedge-shaped cross-sectional area laterally to provide a tactile pressure on outward portion of the golfer's back foot heel area during the golf swing, whereby said first and said second insoles cooperate independently on said front and said rear feet of a golfer to maintain the correct position of each foot during the golf swing.

2. A set of golf shoe insoles as in claim 1, wherein:

each insole is symmetrical to its top side and its bottom side permitting use of both insoles with respect to either left-handed or right-handed golfers.

3. A golf shoe insole for improving the dynamic movement of the golfer's front foot relative to the direction of the ball during a golf swing comprising:

a resilient pad sized to fit within a golf shoe substantially in from the front of the arch to the heel area of the shoe, said pad being thicker along a centerline longitudinal axis from the back of the heel area toward the front of the arch than along the lateral edges, and a transverse cross section being substantially symmetrical on either side of the centerline, said pad centerline thickness being sufficient to provide tactile pressure on the front foot to encourage a rolling motion of the front foot about the centerline axis during the golf swing, said pad centerline thickness being approximately twice the thickness at halfway points laterally from said centerline to said lateral edges.

4. A golf shoe insole as in claim 3, wherein:

said pad being laterally symmetrical both as to its top and bottom.

5. A golf shoe insole as in claim 3, wherein:

said pad is comprised of a resilient foam material.

6. A golf shoe insole as in claim 3, wherein:

said pad's cross sectional configuration from one lateral edge to the opposite lateral edge is arcuate.

7. A golf shoe insole as in claim 3, wherein:

said cross sectional configuration from one edge to the opposite edge includes a bulbous thicker central portion along its centerline symmetrically tapered from the centerline to each edge.

8. A pair of golf shoes, each having a different insole configuration integrally constructed in each shoe to improve the golf swing, comprising:

first insole for the front foot relative to the direction of the ball, said first insole having a centerline longitudinal axis and sized to extend longitudinally from the front of the arch to the back of the heel in a golfer's shoe and laterally across the heel, said first insole having a sufficient thickness along said longitudinal centerline axis that is larger than any other thickness from the centerline to the lateral edges and at least twice as thick at the longitudinal centerline than the thickness at points halfway between each lateral edge and said centerline laterally, said thickness along the longitudinal axis sufficient to provide a tactile pressure on the golfer's front foot heel area to encourage the front foot to achieve a rolling motion about said centerline longitudinal axis during the golf swing; and second insole for the back foot relative to the direction of the ball, said second insole having a first lateral side and a second lateral side and sized in length to extend from the front of the arch to the back of the heel in a golfer's shoe and substantially laterally across the heel area in the shoe, said second insole thickness being larger along said first lateral side than said second lateral side and tapered in diminishing thickness from said first lateral edge to said second lateral edge and forming a wedge-shaped cross-sectional area to provide a tactile pressure on outward portion of the golfer's back foot during the golf swing, whereby said first and said second insoles cooperate independently on said front and said rear feet of a golfer to maintain the correct position of each foot during the golf swing.

* * * * *